United States Patent [19]

Kayser

[11] 4,008,644

[45] Feb. 22, 1977

[54] CLEARING OF LAND MINES

[76] Inventor: Lutz Tilo Kayser, Am Bismarckturm 10, 7 Stuttgart 1, Germany

[22] Filed: Dec. 17, 1974

[21] Appl. No.: 533,676

[30] Foreign Application Priority Data

Dec. 20, 1973 Germany ..... 2363557

[52] U.S. Cl. ..... 89/1 M; 37/12; 299/24; 404/95

[51] Int. Cl.[2] ..... F41H 11/12

[58] Field of Search ..... 89/1 M; 60/35; 102/22; 37/12; 299/24; 404/95

[56] References Cited

UNITED STATES PATENTS

| | | | |
|---|---|---|---|
| 3,112,669 | 12/1963 | Damblane | 89/1 M |
| 3,638,569 | 2/1972 | Thomanek | 89/1 M X |

FOREIGN PATENTS OR APPLICATIONS

| | | | |
|---|---|---|---|
| 1,158,411 | 11/1963 | Germany | 89/1 M |
| 2,121,089 | 11/1972 | Germany | 89/1 M |

*Primary Examiner*—David H. Brown
*Attorney, Agent, or Firm*—Michael J. Striker

[57] ABSTRACT

An apparatus for clearing of land mines are disclosed. One or more rocket engines is mounted above the surface of an area to be cleared, and are then moved over this surface with their stream of exhaust gases directed downwardly towards the surface at a forward angle. The effect of the exhaust gas stream or streams is to exert a plowing action on the land, either detonating or dislodging any land mines that may be buried.

21 Claims, 6 Drawing Figures

CLEARING OF LAND MINES

BACKGROUND OF THE INVENTION

The present invention relates to the clearing of land mines in general, and more particularly to a novel apparatus for clearing land mines.

The clearing of mine fields, or at least of paths through mine fields, has gained ever increasing importance since World War I when land mines were first employed to a significant extent. The need to do so assumed even greater dimensions during World War II when mine fields were widely employed to blunt the thrust of attacking armoured spearheads, as in the battle of the Kursk salient. At that time, clearing of land mines was still largely a matter for sapper units where each individual sought out and deactivated mines one-by-one until a path had been opened through a mine field.

Subsequently, and to a large extent influenced by the development of specific anti-tank mines which are capable of being "seeded" from aircraft across the axis of attack of an armoured thrust, various proposals have been made for facilitating the clearing of mines on a more expeditious basis than previously.

One proposal suggests the use of pyrotechnical devices which are distributed over the area to be cleared and are exploded in order to detonate any mines that are located in this area. However, the distribution of the explosive devices in the area to be cleared is very time consuming and difficult and requires immensely complicated efforts, especially if it must be carried out in the face of hostile fire.

Another approach utilizes mechanical means for clearing, that is rollers, plows, flailing chains or the like, which are moved over the area to be cleared in order to either detonate any mines that are present or to dislodge them and throw them laterally out of the area. All of these devices must of course be propelled over the area to be cleared and in order to be able to withstand a series of mine explosions they must be constructed extremely sturdily. This means that they are expensive to produce and difficult to move about. On the other hand, if they are of light-weight construction they are likely to be destroyed by a single mine explosion, which means that a very large number of such devices must be available at all times, which is not only again a problem in terms of expenditure but may also be difficult to assure under combat conditions.

Where explosive means are used, the amount of explosives required to clear an area, such as a path through a mine field, is directly dependent upon the size of the area to be cleared. As a general rule it has been found that at least 0.5–1 kg explosive per square meter to be cleared, must be available. Moreover, the speed at which an area can be cleared with pyrotechnical or explosive devices depends upon the manner in which the devices can be distributed over the area to be cleared, whereas in the case of mechanical devices it depends upon the time required to repair damage that may have been caused to the equipment by a preceding mine explosion, or the time required to replace a damaged device with a new one. It has been found that the average time required is approximately 1 second per each 10 centimeters (i.e. running centimeters) of area to be cleared. It is evident that when clearing must be effected of mine fields having a depth of perhaps hundreds or even thousands of meters, and in the face of hostile fire, this is a very unsatisfactory approach.

It is of course also known to clear mines in the conventional World War II way, by detecting them with the aid of detecting devices which respond to the presence of metal, geometric forms, local irregularities or the like, and thereupon to render the detected mine ineffective. The speed of clearing is even lower with this approach.

Moreover, aside from the clearing difficulties which are experienced in any case, mine fields are now usually provided with anti-clearing counter measures. For example, it is known to provide metallic parts which are strewn about the mined area to simulate the presence of mines and make the clearing operation more difficult for personnel using mine detectors. It is also known to provide pressure detonators which do not respond to the explosion of mine-clearing pyrotechnical devices, or to provide detonators having a pneumatic-delay or multiple-pulse detonators. It is known to provide booby traps directed against mine clearing personnel, or to provide explosive charges which are to destroy mine clearing equipment and/or the carrier vehicle for the same.

Summary of the Invention

It is a general object of the present invention to overcome the disadvantages of the prior art.

More particularly, it is an object of this invention to provide an improved apparatus for clearing land mines, particularly but not exclusively anit-tank mines.

The present invention is to avoid the disadvantages of the prior art and to make possible a rapid, safe and reliable clearing of a mined area, that is of a mine field or a passage through a mine field.

In keeping with these objects, and with others which will become apparent hereafter, one feature of the invention resides in a novel apparatus for clearing land mines, particularly anti-tank mines. This apparatus comprises a rocket engine having a thrust nozzle from which a stream of high-velocity gases issues when the engine is in operation. Support means supports the rocket engine above the surface of an area to be cleared, and for movement over this surface. Mounting means mounts the rocket engine on the support means so that the thrust nozzle faces towards the surface and the gas stream impinges the surface to plow it up and detonate or dislodge any land mines that are present.

The gas stream of a rocket engine attains velocities in excess of 2000 meters per second and its thrust can be made to reach or even exceed 100 atmospheres. Thus, when the gas stream impinges the ground, the latter is plowed up and the topsoil and all materials imbedded in it is flung away in fractions of a second. Depending upon the composition of the soil the gas stream may plow the ground to a depth of approximately 0.5 meters and may fling the dislodged soil and any embedded land mines away in the flow direction of the gas stream by distances of approximately 6 meters. The same effect is obtained in shallow waters, and also in snow and ice.

The support means may be in form of a vehicle that is either self-propelled or that is simply a carrier which is propelled by another vehicle, for example a heavy truck or a tank.

It is particularly advantageous if the front end of the vehicle carries two rocket engines, one at each side, which are so angled that their gas streams cross one another in space (but do not physically intersect). The right-hand rocket engine, seen in the direction of forward movement, should be inclined towards the left side of the vehicle and in forward direction, and the left-hand rocket engine should be inclined towards the right side of the vehicle and in forward direction, and of course both of them should be directed downwardly towards the ground. The angle of inclination between the transverse axis of the vehicle and the longitudinal axis of the respective rocket engine may be between approximately 0° and 90°. To assure that the two gas streams do not physically intersect, the angles of inclination between the horizontal and the longitudinal axis of the respective rocket engine, measured in a vertical plane, are of different sizes and may be between substantially 15° and 45°, preferably approximately 30°. The same effect is obtained if the rocket engines are vertically and/or horizontally offset relative to one another on the vehicle.

The effective field of the two rocket engines overlaps and because of their arrangement wherein each rocket engine gas stream is directed laterally outwardly beyond the opposite lateral side of the vehicle, a path is cleared as the vehicle travels over an area, and this path will have a width that is substantially greater than the width of the vehicle.

The rocket engines may also be mounted on the underside of a heavy helicopter, and of course they must again be arranged as mentioned before. It is advantageous in this case if the rocket engines are located in a substantially vertical plane extending transversely to the longitudinal extension of the helicopter in order to avoid axially acting force components. In order to prevent physical intersection of the gas streams from the two rocket engines it is advantageous if the rocket engines are longitudinally offset relative to one another in lengthwise direction of the helicopter.

Various different types of rocket engines can be used; advantageously they will be of the liquid-fuel type, but they could also be of the solid-fuel type or hot water type.

It is also advantageous if the rocket engines together with their fuel tanks are constructed as separate units that can readily be replaced with new ones so that, when the fuel for an engine is gone, a new unit can readily be put in place of the old one.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
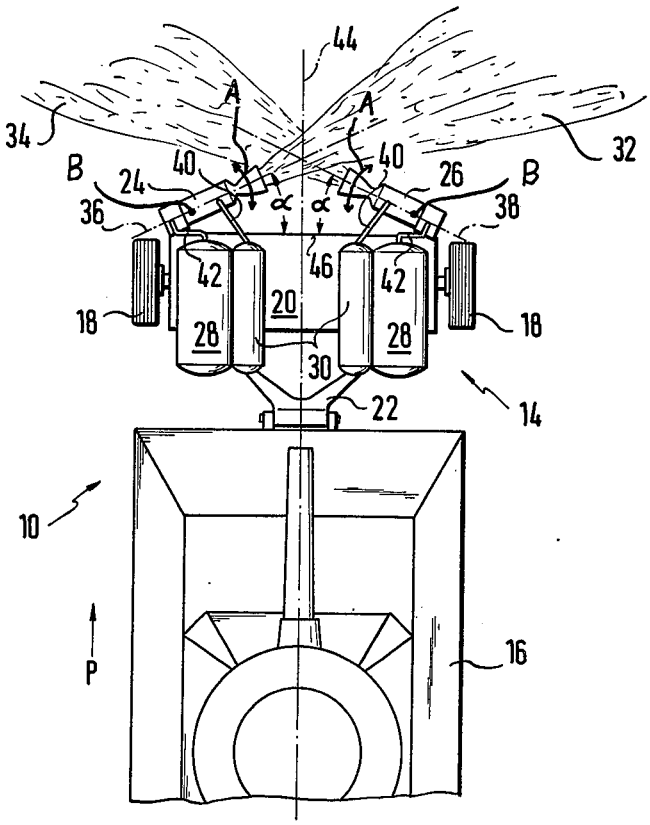
FIG. 1 is a top-plan view of a first embodiment of the invention.

The novel apparatus and invention will first be discussed jointly with respect to the two embodiments that have been illustrated in the drawing, that is the embodiment of FIGS. 1 and 2 and the embodiment of FIG. 3.

Figure 2:
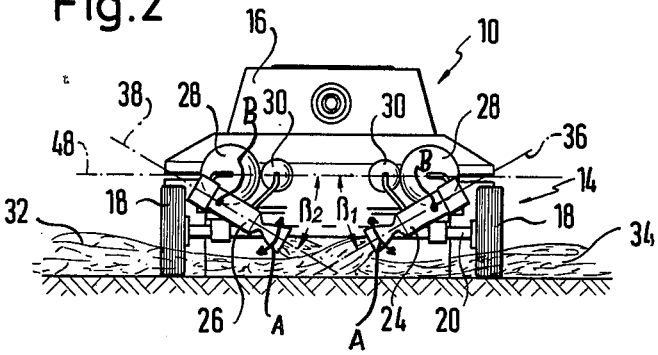
FIG. 2 is a front-elevational view of the embodiment in FIG. 1.

The embodiment of FIGS. 1 and 2 has a clearing apparatus 10 which utilizes a support in form of a carriage 14 which for example has two wheels 18, a chassis 20 and a mounting arrangement 22 by means of which it can be connected to a propelling vehicle, which here is a tank 16. The construction of the carriage 14, its size, width, height or the number of wheels is of no importance for the present invention and can be selected freely in dependence upon the particular requirements.

According to the invention, two rocket engines 24 and 26 are mounted on the carriage 14. Again, the components for mounting the rocket engines have not been illustrated because they are not essential for the invention and can be freely selected and will be readily understood by those skilled in the art.

The rocket engines 24 and 26 are connected by means of conduits 40 and 42 with their respective fuel supply tanks, for instance fuel tanks 30 and oxidant tanks 28. The tanks 28 and 30 are also mounted on the carriage 14 and appropriately held in place. It is advantageous if each of the rocket engines 24 and 26 forms together with its tanks 28 and 30 a complete autonomous unit, which is advantageously so mounted on the carriage 14 that the unit can be readily removed and replaced with a new one.

FIG. 1 shows that the engines 24 and 26 are mounted at the front end of the carriage 14, the engine 26 being mounted at the right-hand side and the engine 24 at the left-hand side, as seen with reference to the direction of forward movement which is indicated by the arrow P. The longitudinal axes 36 and 38 of the engines 24 and 26, respectively, each form an acute angle $\alpha$ with a line 46 which extends transversely to the longitudinal axis 44 of the carriage 14. The angle $\alpha$ may be between substantially zero and approximately 90°, but advantageously it is between approximately 15° and 60°, and in this range approximately 30°–45° is currently preferred. It is advantageous if the angle $\alpha$ is the same for both of the rocket engines 24 and 26, but — in order to accommodate the arrangement to particular soil contours — it can be different for the two engines. For this purpose the carriage 14 may be provided with devices which make it possible to tilt the rocket engines 24 and 26 in a horizontal as well as in a vertical plane; such devices have not been illustrated because they are well known in the art and entirely conventional. The vertical tilting axes are shown, for tilting the engines in horizontal planes as indicated by arrows A.

When the rocket engines are fired up, gas streams 32 and 34 issue from their thrust nozzles. The gas stream 32 of the rocket engine 24 is directed forwardly of the carriage 14 and towards the right-hand side of the latter, whereas the gas stream 34 of the right-hand rocket engine 26 is also directly forwardly but towards the left-hand side of the carriage 14. In the region of the longitudinal axis 44 the gas streams overlap, but they must not physically intersect one another. When the vehicle now travels in the direction of the arrow P, a continuous surface area which is substantially wider than the carriage 14 itself, will be cleared by the gas streams 32 and 34.

FIG. 2 shows particularly clearly that the engines 24 and 26 are inclined not only forwardly with respect to the carriage 14, but are also inclined downwardly towards the ground with reference to the horizontal 48, at angles $\beta 1$ and $\beta 2$. In this connection it is pointed out that FIG. 2 does not show the true angles $\beta 1$ and $\beta 2$, but their projection upon the plane of the drawing. The sweep of the gas streams in direction laterally away from the carriage 14 after the streams impinge the ground, is clearly visible in FIG. 2.

As pointed out before, it is important that the gas streams must not physically intersect one another, because that would interfere with their effectiveness. To assure this, the angles $\beta 1$ and $\beta 2$ have different values so that one gas stream passes over the other, as is evident in FIG. 1 for example. It is advantageous if the angles $\beta 1$ and $\beta 2$ are within a range of approximately 15°–45°, and preferably at approximately 30°, always measured in a vertical plane in which the respective axis 36 and 38 is located.

Figure 4:
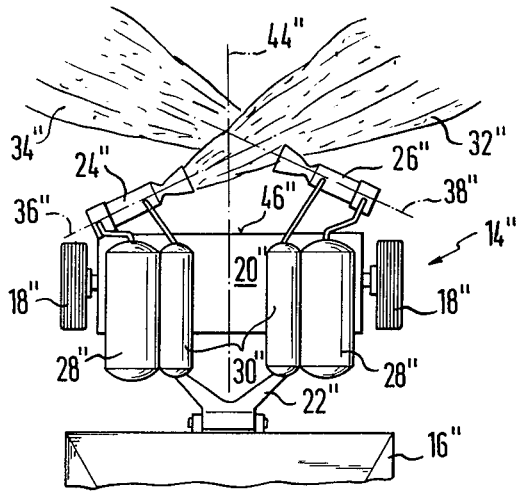
FIG. 4 is similar to FIG. 1, showing a modification.
Figure 5:
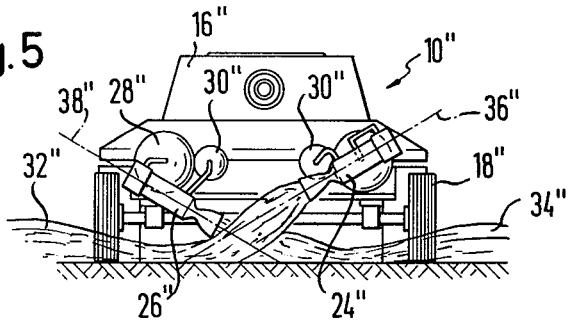
FIG. 5 is similar to FIG. 2, showing another modification.

The same purpose, that is the prevention of a physical intersection of the gas streams, can also be achieved if the rocket engines 24 and 26 are offset horizontally and/or vertically relative to one another wherein double-primed numerals are used to designate similar elements, as respectively indicated in the otherwise self-explanatory FIGS. 4 and 5.

Figure 3:
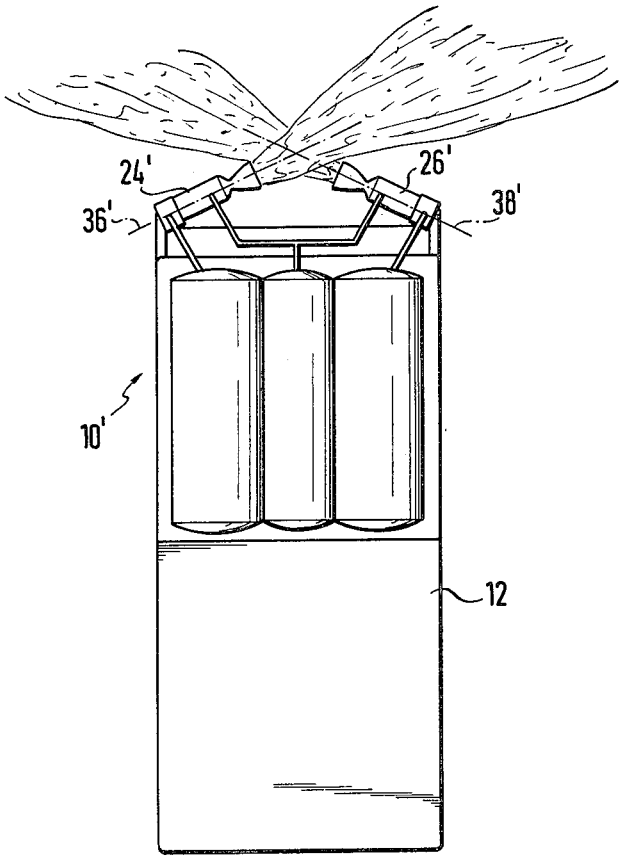
FIG. 3 is a top-plan view showing a further embodiment of the invention.

The embodiment in FIG. 3 is somewhat of a modification of that in FIGS. 1 and 2. In FIG. 3 the carriage 12 is self-propelled and therefore does not require a tank or similar device to effect its movement. Details of the propulsion unit have not been illustrated because these are of no importance for the invention. Any suitable self-propelled vehicle can be utilized.

As in FIGS. 1 and 2, the embodiment of FIG. 3 again uses a pair of rocket engines 24′ and 26′ which are each again connected with their respective supply tanks. The rearward portion of the carriage 12, that is the rearward portion with respect to the direction of forward movement, may be constructed as a cabin for one or more operators, for example an armoured cabin. The arrangement and operation of the rocket engines 24′ and 26′ is the same as described with respect to FIGS. 1 and 2.

Figure 6:
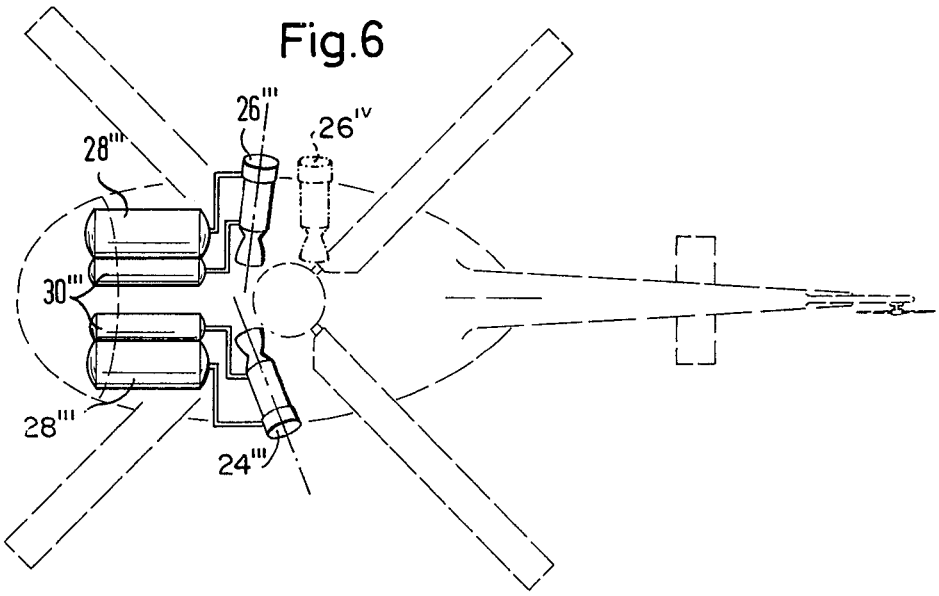
FIG. 6 is a bottom-plan view of still a further embodiment.

According to a further concept of the invention the rocket engines 24‴ and 26‴ may also be mounted on the underside of a heavy helicopter as shown in FIG. 6. Analogously to the arrangement in FIG. 2, one of the rocket engines will be located at one lateral side of the helicopter and the other at the opposite lateral side of the helicopter, the right-hand side rocket engine being inclined forwardly, downwardly and towards the left side, and the left-hand side rocket engine being inclined forwardly, downwardly and to the right side. In order to eliminate axial force components the longitudinal axes of the rocket engines 24‴ 26‴ in this case will be located in different vertical planes transverse to the longitudinal axis of the helicopter, so that the angle $\alpha$ shown in FIG. 1 equals zero in this embodiment. The angle of inclination between the horizontal and the respective longitudinal axis of the rocket engines, which is designated as $\beta 1$ and $\beta 2$ in FIGS. 1 and 2, will here also be advantageously between approximately 15°–45°, and preferably approximately 30°.

To prevent in this embodiment the exhaust gas streams from physically intersecting one another, the rocket engines are advantageously offset longitudinally of the helicopter with reference to one another (see engine 24‴ and $26^{IV}$), so that the two exhaust gas streams pass one another in space. Of course, care must be taken that the torque which tends to be exerted upon the helicopter is appropriately overcome. It would also be possible to subdivide the exhaust gas stream of one of the rocket engines into two parts which flow at a distance and in parallelism to one another, whereas the exhaust gas stream of the other rocket engine would then pass between these two parts; this would eliminate the development of a torque upon the helicopter.

I currently prefer to use liquid-fuel rocket engines, but it is possible to use solid fuel rocket engines or hot-water rocket engines. The use of liquid fuel rocket engines has the advantage that diesel oil may be used as the fuel, that is the same fuel as will ordinarily be used for propelling the propulsion vehicle. This can be of considerable importance in terms of the availability of fuel. It is also advantageous that the rocket engines be of simple and inexpensive construction, and that they can be switched on and off as often as required. Another advantage is obtained if the thrust of the rocket engines can be throttled as may be needed.

In operation of the novel invention, the vehicle 12 travels under its own power over the area to be cleared, or else the carriage 14 is pushed by a propelling vehicle, such as the tank 16. Alternately, the helicopter flies at a low level over the surface of the area to be cleared. Before the suspected mine field is reached, the rocket engines are turned on so that the two streams of exhaust gases impinge the surface of the area that is suspected to be mined. Because of the high velocity in excess of 2000 meters per second and because of the thrust of up to or perhaps even more than 100 atmospheres, the soil located ahead of and laterally of the support that carries the rocket engines, together with anything embedded in it, is immediately dug up and flung away in lateral direction, the digging occurring to a depth of approximately 0.5 meters depending on soil condition and vehicle speed, and the width in which the digging occurs being on the order of approximately 6 meters.

The thrust of a rocket engine having approximately 3 tons of thrust is capable of flinging an anti-tank mine of approximately 10 kilograms and 30 centimeter diameter away in lateral direction with an acceleration of several hundred g, so that even if the mine explodes the explosion will take place only as it is already being flung away and will therefore not be able to damage the equipment. The equipment may be manned or unmanned; in the latter case it may be remote controlled. It can travel at a high speed of approximately 20 meters per second through the mine field so that a typical path of 200 meters length and 6 meters width can be cleared in approximately 10 seconds. The increase in the speed of clearing over the earlier-mentioned methods is of course readily apparent, and the relatively high speed of the vehicle adds an extra dimension of protection for the vehicle, not only against damage by any mines that may explode but also against hostile action.

The specific fuel requirement for the rocket engines is relatively low and amounts to approximately 0.1–0.5 kg of fuel per square meter of cleared area. A suitable rocket engine of approximately 3 tons of thrust will require approximately 600 kg of fuel during a burning time of 50 seconds.

If a helicopter is used to carry the rocket engines, an uncleared strip will remain immediately beneath the helicopter since the gas streams of the rocket engines are inclined downwardly and laterally. In this case, two cleared paths of approximately 6 meters width each will be obtained; if the uncleared strip is also to be cleared, the helicopter would have to make another pass across the mine field in order to clear the previously uncleared area.

It will be understood that each of the elements described above, or two or more together, may also find a useful application in other types of constructions differing from the types described above.

While the invention has been illustrated and described as embodied in an apparatus for clearing land mines, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An apparatus for clearing land mines, particularly anti-tank mines, comprising a pair of rocket engines each having a thrust nozzle from which a stream of high-velocity gases issues when the engine is in operation; support means for supporting said rocket engines above the surface of an area to be cleared, and for movement over said surface; and mounting means for mounting said rocket engines at spaced locations on said support means so that said thrust nozzles face towards said surface and in mutually opposite directions transverse to the direction of movement of said support means, said rocket engines being arranged on said support means so that the respective gas streams overlap and cross each other in space without physically intersecting each other and thereby impinge at least those portions of the surface lying ahead and underneath said support means as considered with reference to the direction of movement of the latter, to plow the surface up and detonate or dislodge any land mines that are present.

2. An apparatus as defined in claim 1, wherein said rocket engines are liquid-fuel engines.

3. An apparatus as defined in claim 1, wherein said rocket engines are solid-fuel engines.

4. An apparatus as defined in claim 1, wherein each rocket engine is hot-water engine.

5. An apparatus as defined in claim 1, wherein said support means comprises a surface vehicle having a front end, said rocket engines being mounted at said front end on opposite lateral sides of said vehicle, and each of said nozzles being inclined downwardly towards said surface and transversely of the direction of movement of said vehicle at a forward angle.

6. An apparatus as defined in claim 5, wherein the engine which in direction of movement is the right-hand one has its nozzle inclined towards the left-hand side of the vehicle, and the left-hand engine has its nozzle inclined towards the right-hand side of the vehicle.

7. An apparatus as defined in claim 5, wherein said vehicle is self-propelled.

8. An apparatus as defined in claim 5, wherein said vehicle is an unpowered vehicle.

9. An apparatus as defined in claim 5, wherein said rocket engines are pivotable at angles of substantially 0° and 90° between said direction of movement and a transverse axis of said vehicle which extends normal to said direction.

10. An apparatus as defined in claim 5, wherein said rocket engines are inclined at mutually different angles relative to said direction and said surface, so that said gas streams do not interfere with one another.

11. An apparatus as defined in claim 5, wherein said rocket engines are offset relative to one another in at least one of the horizontal and vertical directions, so that their gas streams do not interfere with one another.

12. An apparatus as defined in claim 1; said nozzles which face in mutually opposite directions transversely of the direction of movement being inclined at forward angles.

13. An apparatus as defined in claim 12, wherein the angles included by said nozzles between the surface and said direction of movement are between substantially 15° and 45°.

14. An apparatus as defined in claim 12, wherein said angles are about 30°.

15. An apparatus as defined in claim 12, wherein said engines are pivotable in horizontal planes.

16. An apparatus as defined in claim 15, wherein said engines are pivotable in vertical planes.

17. An apparatus for clearing land mines, particularly anti-tank mines, comprising a pair of rocket engines each having a thrust nozzle from which a stream of high-velocity gases issues when the engine is in operation; support means for supporting said rocket engines above the surface of an area to be cleared, and for movement over said surface; and mounting means for mounting said rocket engines at spaced locations on said support means so that said thrust nozzles face towards said surface and in mutually opposite directions transverse to the direction of movement of said support means, said rocket engines being arranged on said support means so that the respective gas streams overlap and cross each other in space without physically intersecting each other and thereby impinge at least those portions of the surface lying underneath said support means, to plow the surface up and detonate or dislodge any land mines that are present.

18. An apparatus as defined in claim 17, wherein said support means comprises a helicopter, said rocket engines being mounted at opposite lateral sides of said helicopter, and each of said nozzles also being inclined downwardly towards said surface and transversely of the direction of movement of said helicopter at a forward angle so as to face those portions of the surface which lie ahead of said support means, as considered with reference to the direction of movement of the latter.

19. An apparatus as defined in claim 18, wherein the engine which is the right-hand one in said direction of travel, is inclined towards the left side of the helicopter, and the left-hand engine is inclined toward the right side of the helicopter.

20. An apparatus as defined in claim 18, wherein said engines are located in substantially vertical planes extending transverse to the longitudinal axis of said helicopter.

21. An apparatus as defined in claim 18, wherein said engines are mutually offset lengthwise of said helicopter so that said gas streams will not interfere with one another.

* * * * *